US011647852B1

(12) United States Patent
Rinehart

(10) Patent No.: US 11,647,852 B1
(45) Date of Patent: May 16, 2023

(54) FITTED BED SKIRT AND METHOD FOR DECORATING A BED STRUCTURE

(71) Applicant: LoRusso Ventures, LLC, Huntersville, NC (US)

(72) Inventor: Krista LoRusso Rinehart, Huntersville, NC (US)

(73) Assignee: LoRusso Ventures, LLC, Huntersville, NC (US)

( * ) Notice: Subject to any disclaimer, the term of this patent is extended or adjusted under 35 U.S.C. 154(b) by 0 days.

(21) Appl. No.: 17/543,120

(22) Filed: Dec. 6, 2021

Related U.S. Application Data

(63) Continuation of application No. 15/777,388, filed as application No. PCT/US2016/063096 on Nov. 21, 2016, now abandoned.

(60) Provisional application No. 62/257,306, filed on Nov. 19, 2015.

(51) Int. Cl.
*A47G 9/02* (2006.01)

(52) U.S. Cl.
CPC ..... *A47G 9/0292* (2013.01); *A47G 9/0246* (2013.01)

(58) Field of Classification Search
CPC ..... A47G 9/0292; A47G 2009/0276; A47G 9/0246
USPC ..... 5/488, 493, 663
See application file for complete search history.

(56) References Cited

U.S. PATENT DOCUMENTS

| | | | |
|---|---|---|---|
| 3,906,559 | A | 9/1975 | Bahr |
| 4,704,753 | A | 11/1987 | Lunt |
| 5,003,655 | A | 4/1991 | Kafai |
| 5,027,460 | A | 7/1991 | Honig |
| 5,271,112 | A | 12/1993 | Bible |
| 5,749,110 | A | 5/1998 | Gamble |
| 6,276,009 | B1 | 8/2001 | Schrougham |
| 7,337,480 | B2 | 3/2008 | Borino |
| 7,757,315 | B2 | 7/2010 | Lopez-Rettew |
| 7,827,633 | B2 | 11/2010 | Taylor |
| 8,032,959 | B2 | 10/2011 | Rowson |
| 9,357,863 | B1 | 6/2016 | Goenka |
| 2004/0226089 | A1 | 11/2004 | Miranda |
| 2007/0251006 | A1 | 11/2007 | Kennett |
| 2011/0308013 | A1 | 12/2011 | Kennett |
| 2012/0066835 | A1 | 3/2012 | Kelly |
| 2014/0338128 | A1 | 11/2014 | Robson |

(Continued)

FOREIGN PATENT DOCUMENTS

| | | |
|---|---|---|
| GB | 887521 | 1/1962 |
| GB | 2489305 | 9/2012 |
| WO | WO2010081197 | 7/2010 |

OTHER PUBLICATIONS

Cinch Skirt Video.' Krista LoRusso, Nov. 21, 2016 (Nov. 21, 2016) [online], [retrieved on https://www.youtube.com/watch?v=xpF8HJLDMLw>. Entire document.

*Primary Examiner* — Michael Safavi
(74) *Attorney, Agent, or Firm* — Schwartz Law Firm, P.C.

(57) ABSTRACT

A fitted bed skirt is applied to rectangular bed structure having flat top and bottom surfaces, opposing vertical head and foot ends, and opposing vertical sides. The bed skirt includes a decorative fabric covering comprising first and second side panels and an end panel formed with the side panels. The side and end panels cooperate to cover the vertical sides and vertical foot end of the bed structure, and define a generally U-shaped form when applied to the bed structure. An elastic end strap joins the first and second side panels together, and is adapted for extending horizontally along the vertical head end of the bed structure.

18 Claims, 7 Drawing Sheets

(56) References Cited

U.S. PATENT DOCUMENTS

| | | | |
|---|---|---|---|
| 2015/0013067 | A1 | 1/2015 | Coughlin |
| 2015/0040316 | A1 | 2/2015 | Graves |
| 2017/0340145 | A1 | 11/2017 | McCullough |
| 2018/0049558 | A1 | 2/2018 | Jurcenko |
| 2019/0099020 | A1 | 4/2019 | Stewart |

FITTED BED SKIRT AND METHOD FOR DECORATING A BED STRUCTURE

TECHNICAL FIELD AND BACKGROUND OF THE DISCLOSURE

The present disclosure relates broadly and generally to a decorative fitted bed skirt for a bed structure, such as a box spring, mattress foundation, or other bed base or mattress. The exemplary bed skirt is designed to wrap around and conceal a portion of the bed structure to promote an aesthetically modern and clean look in any room, particularly hotel guestrooms.

Traditionally, the installation of prior art decorative bed skirts between a mattress and box spring has been a generally cumbersome, time consuming, and labor intensive process. The process typically begins by first removing all pillows, blankets, sheets, and other bedding from the mattress. The mattress is then lifted and removed from the box spring, and leaned vertically against an adjacent wall—often a job for two or more people. With the mattress removed, the bed skirt is then spread out and laid flat over the top surface of the box spring, and adjusted so that the corners of the skirt and the corners of the box spring properly align. At that point, the mattress is again lifted and placed back on top of the box spring, so that the bed skirt is held securely in place. With the mattress returned to the bed, the bed skirt is gently tugged on the sides to even out the edges. Finally, the pillows, sheets, blankets, and other bedding are replaced on the mattress.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a fitted bed skirt (or cover) for a rectangular bed structure having flat top and bottom surfaces, opposing vertical head and foot ends, and opposing vertical sides. The bed skirt includes a decorative fabric covering comprising first and second side panels and an end panel formed with the side panels. The side and end panels cooperate to cover the vertical sides and vertical foot end of the bed structure, and define a generally U-shaped form when applied to the bed structure. An elastic end strap joins the first and second side panels together, and is adapted for extending horizontally along the vertical head end of the bed structure.

The term "bed structure" refers broadly herein to any bed, bed base, mattress foundation, box spring, bedframe, or mattress.

According to another exemplary embodiment, the decorative fabric covering further comprises a continuous elastic flange sewn along opposing edges of the side panels and the end panel.

According to another exemplary embodiment, the elastic end strap has a width dimension designed to be less than a height of the vertical head end of the bed structure, such that no portion of the end strap extends across the top or bottom surfaces of the bed structure.

According to another exemplary embodiment, the decorative fabric covering is designed to cover less than 40% of the top surface of the bed structure.

According to another exemplary embodiment, the decorative fabric covering is designed to cover less than 40% of the bottom surface of the bed structure.

According to another exemplary embodiment, the decorative fabric covering further comprises opposing integrally formed foot-end corner pockets adapted to receive respective corners of the bed structure at its foot end.

According to another exemplary embodiment, each foot-end corner pocket has a depth of between 5 and 15 inches.

According to another exemplary embodiment, the decorative fabric covering further comprises opposing integrally formed head-end corner pockets adapted to receive respective corners of the bed structure at its head end.

According to another exemplary embodiment, each head-end corner pocket has a depth of between 5 and 15 inches.

According to another exemplary embodiment, the side and end panels of the decorative fabric covering comprise elastic yarns.

In another exemplary embodiment, the present disclosure comprises a bed structure incorporating a decorative bed skirt as further described herein.

In yet another exemplary embodiment, the present disclosure comprises a method for installing a decorative bed skirt on a bed structure—the bed skirt comprising the exemplary structural elements and features described herein.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafterwith reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
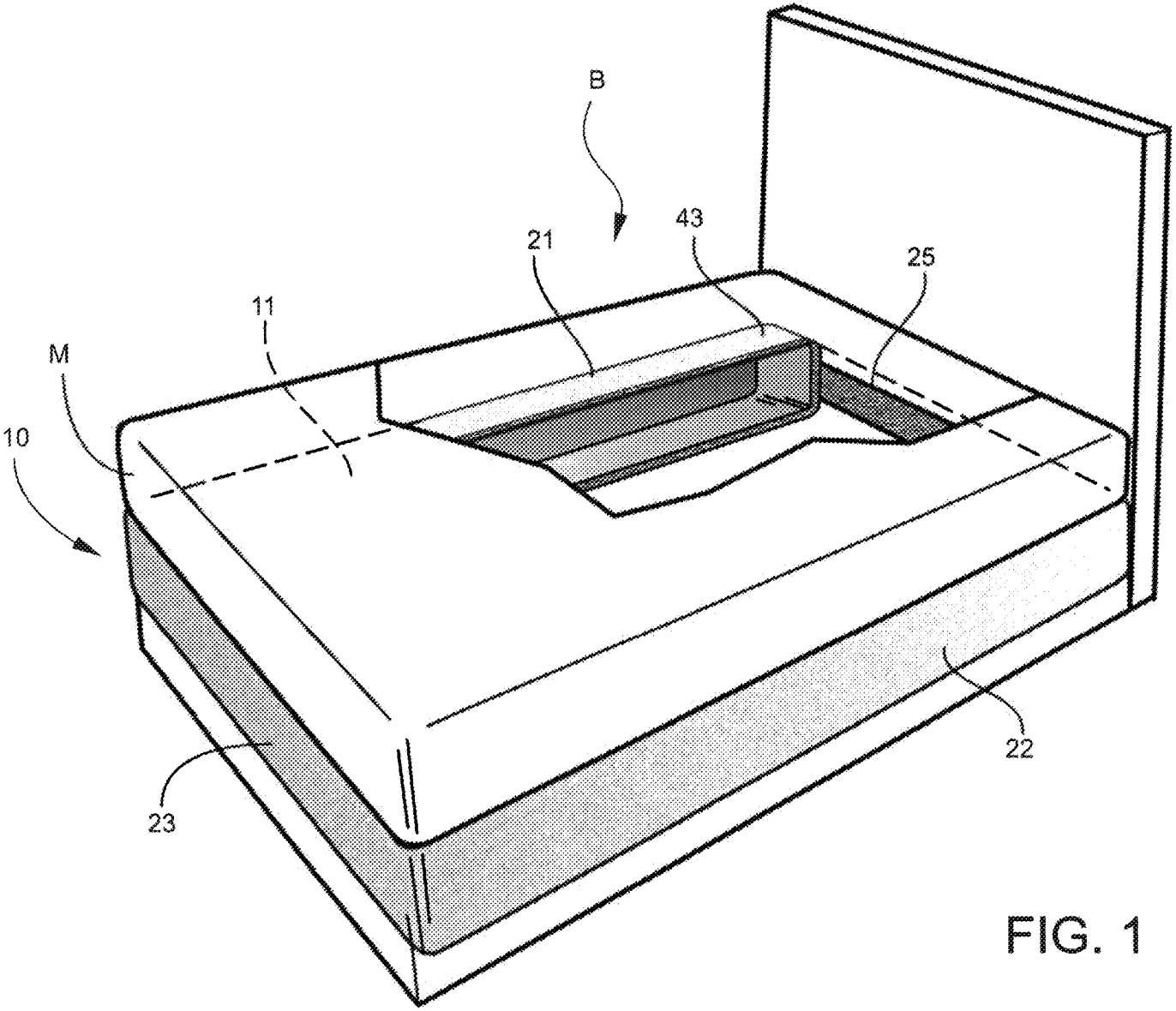
FIG. 1 is a perspective of an assembled bed comprising a mattress and box spring combination, and showing the present exemplary bed skirt applied to the box spring to aesthetically conceal its vertical sides and foot end.
Figure 2:
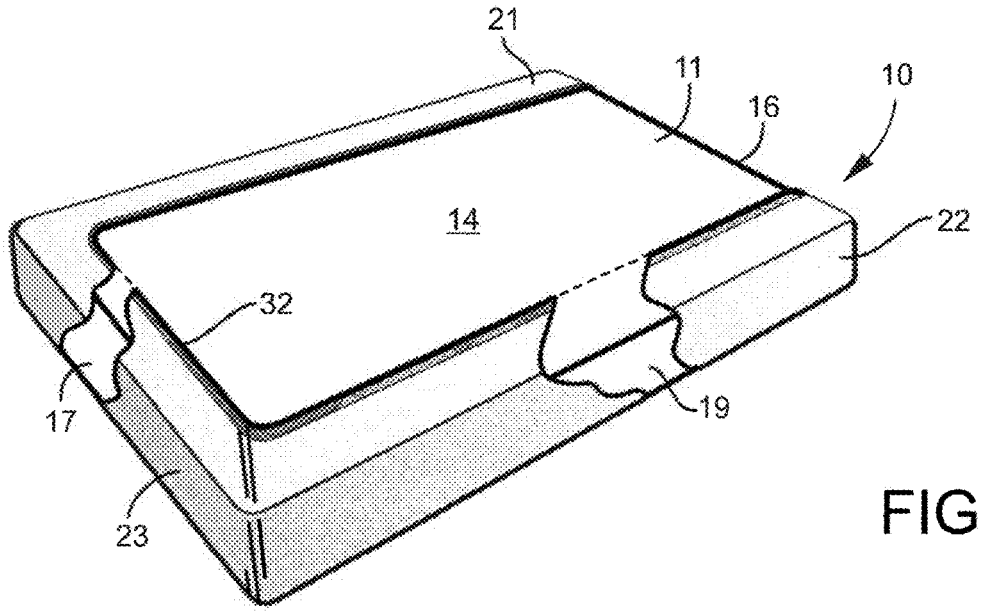
FIG. 2 is a perspective view showing a top surface of the box spring covered with the exemplary bed skirt.
Figure 3:
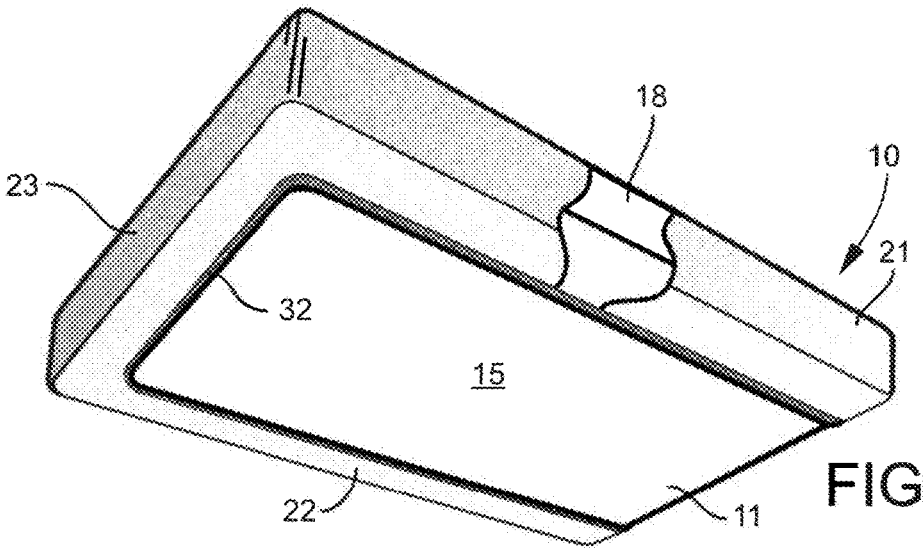
FIG. 3 is a perspective view showing a bottom surface of the box spring covered with the exemplary bed skirt.
Figure 4:
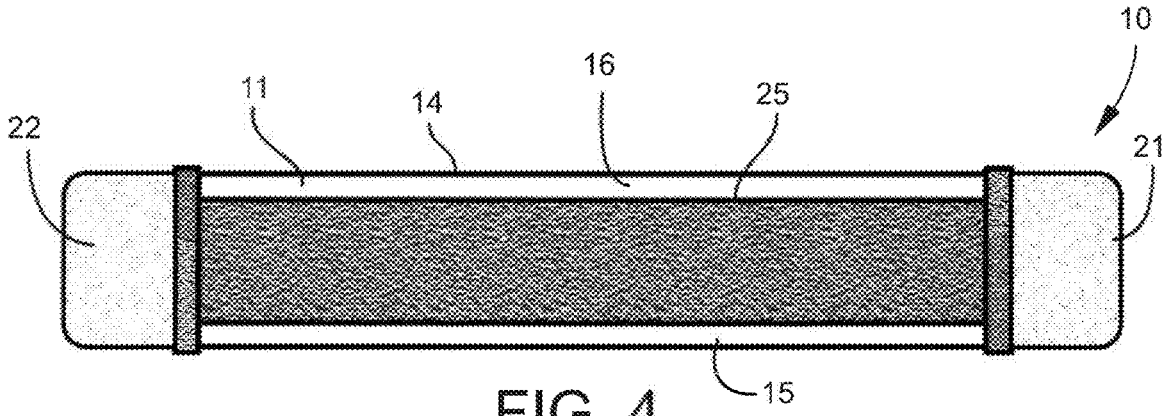
FIG. 4 is an end view of the box spring covered with the exemplary bed skirt.

Referring now specifically to the drawings, a decorative fitted bed skirt according to one exemplary embodiment of the present disclosure is illustrated in FIG. 1, and shown generally at broad reference numeral 10. The exemplary bed skirt 10 is applicable for use with a rectangular bed structure, such as conventional box spring 11, designed to support a mattress "M" in an assembled bed "B". As shown in FIGS. 2, 3, and 4, the box spring 11 has flat (e.g., planar) top and bottom major surfaces 14, 15, opposing vertical head and foot ends 16, 17, and opposing vertical sides 18, 19. The bed skirt 10 may fit tight against the box spring 11 as shown, or may drop to the floor, or may be combined with other decorative fabric components (such as a valance) that attaches to the bed skirt and that may or may not drop to the floor. An attached or integrated valance may hide any storage space under the bed "B", and may also help prevent an accumulation of dust.

Referring to FIGS. 1-4, the exemplary bed skirt 10 comprises a decorative fabric covering 20 incorporating first and second fabric side panels 21, 22, and a fabric end panel 23 integrally formed with the side panels 21, 22. The side and end panels 21-23 cooperate to aesthetically conceal the vertical sides 18, 19, and vertical foot end 17 of the box spring 11, and define a generally U-shaped cover when stretch and applied to the box spring 11. An elastic end strap 25, shown in FIG. 4, joins the first and second side panels 21, 22 together, and extends horizontally along the vertical head end 16 of the box spring 11 to elastically fit and tighten the bed skirt 10 on the box spring 11. In the exemplary embodiment, the width of the end strap 25 is designed to be less than a height of the vertical head end 16 of box spring 11, such that no portion of the end strap 25 extends across the top or bottom surfaces 14, 15 of the box spring 11, thereby facilitating application of the bed skirt 10 in often hard-to-reach areas of the bed "B".

Figure 5:
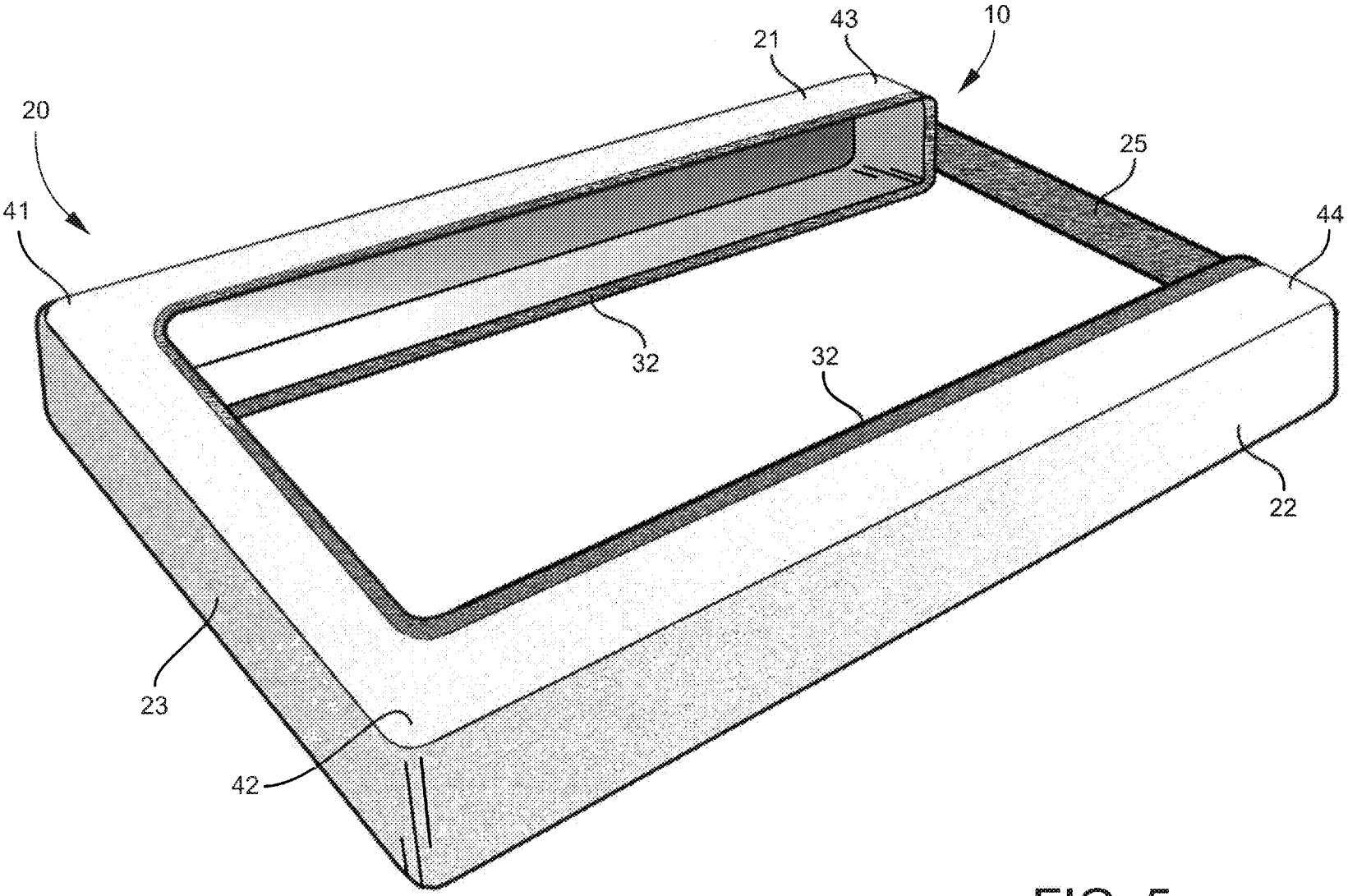
FIG. 5 is a perspective view of the exemplary bed skirt in a stretched condition.
Figure 6:
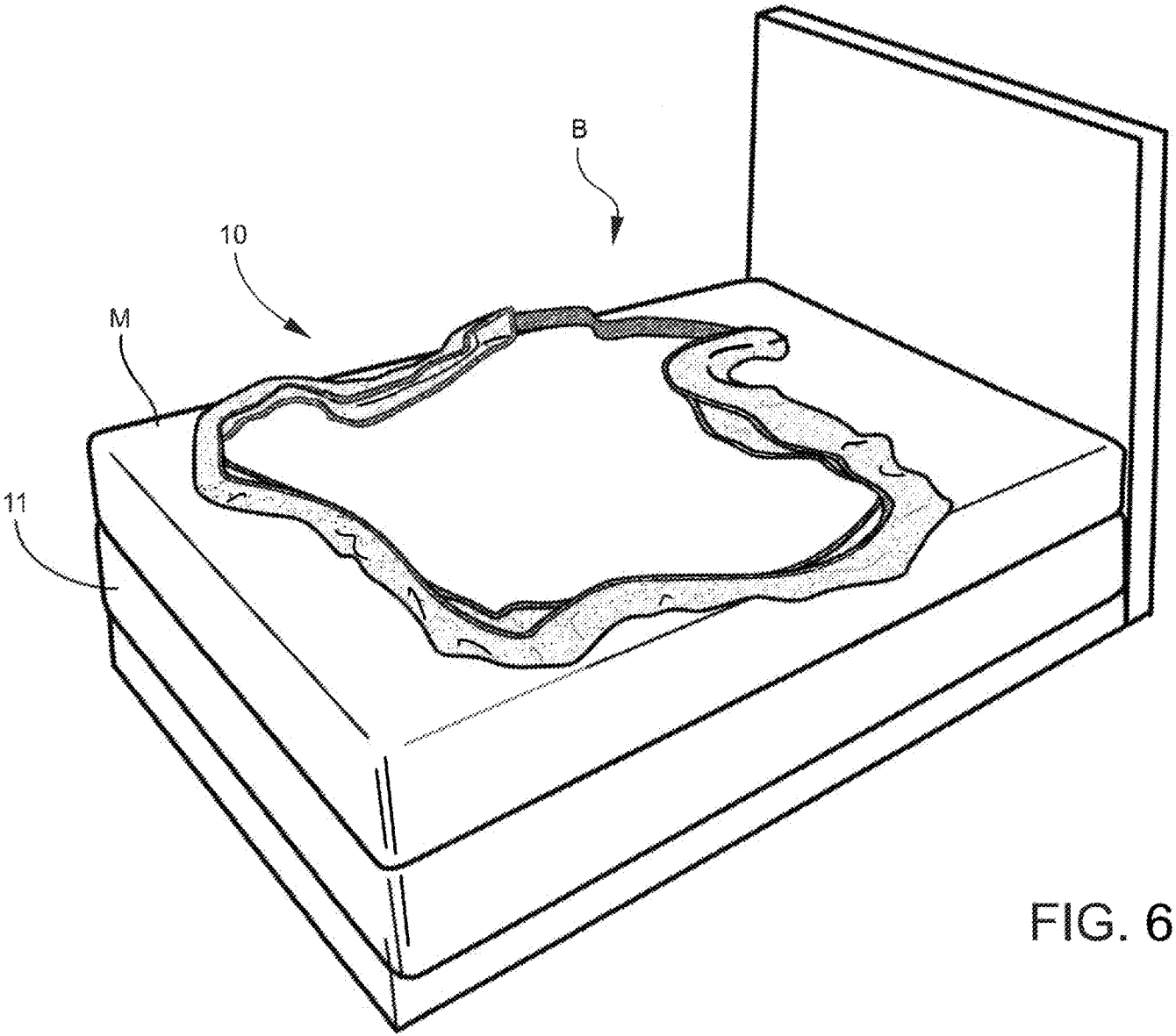
FIGS. 6-9 demonstrate sequential application of the exemplary bed skirt onto the box spring.
Figure 7:
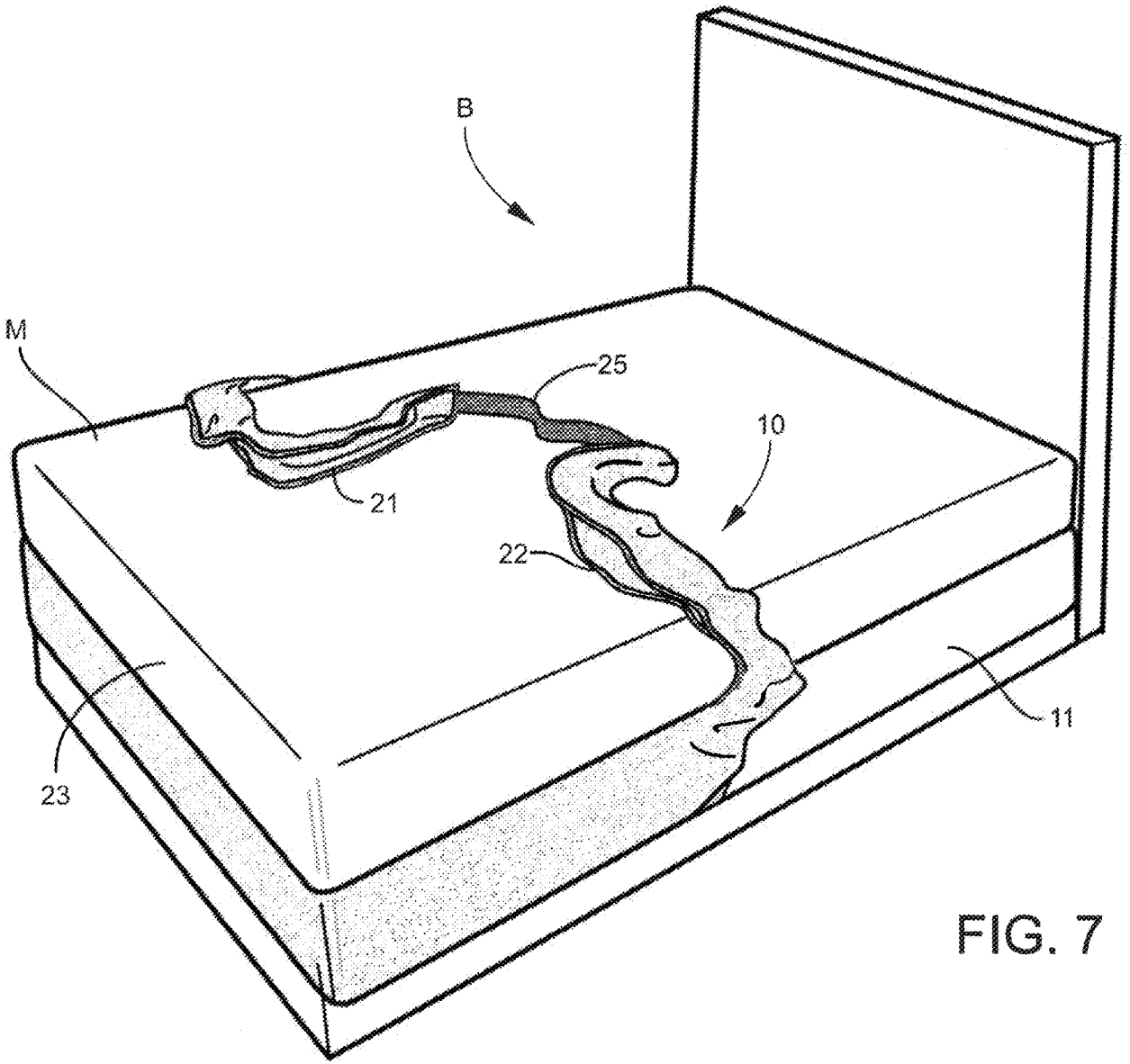
Figure 8:
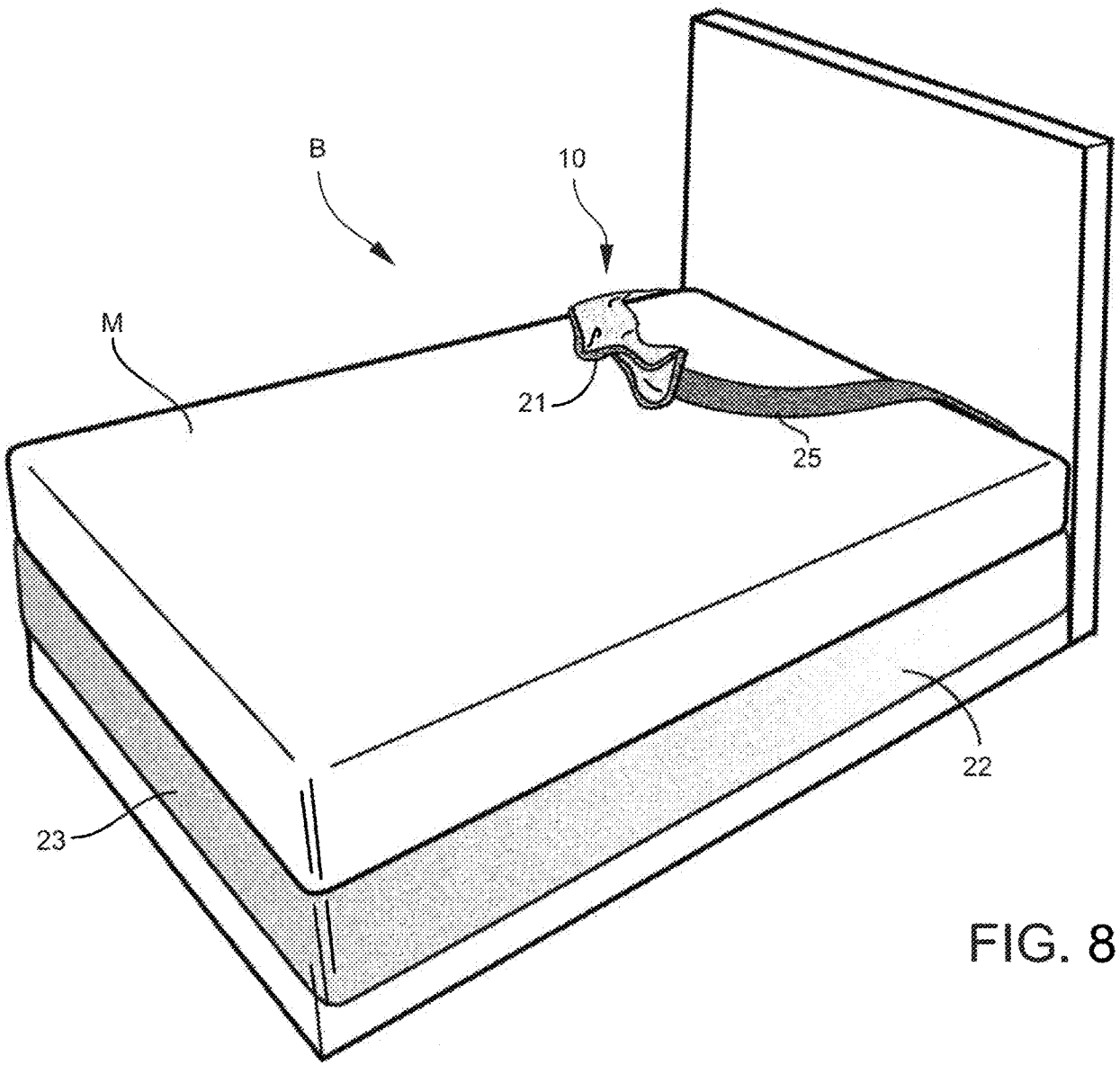
Figure 9:
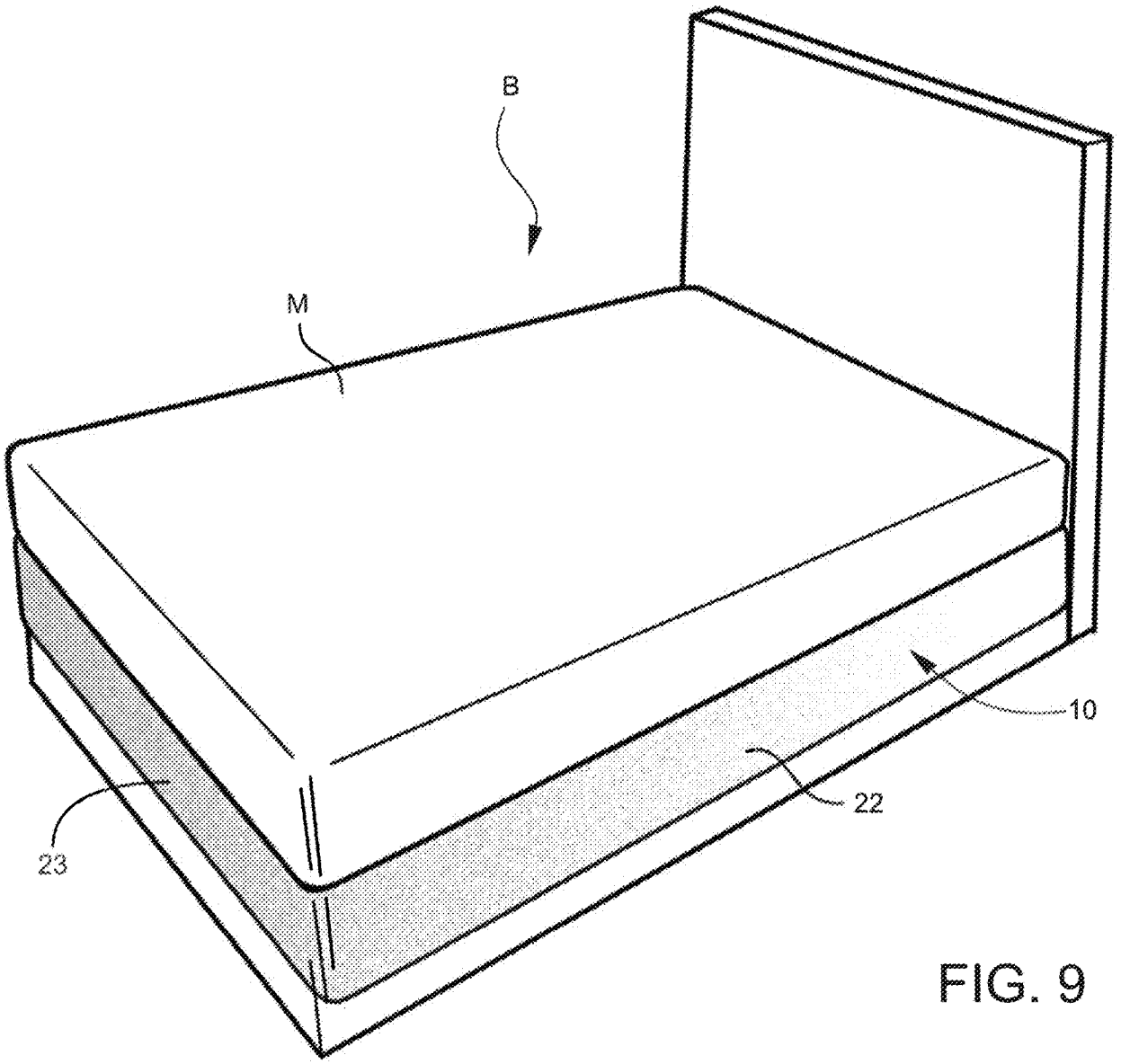

Referring to FIGS. 2, 3, and 5, the exemplary decorative covering 20 comprises a continuously-extending, elastic flange 32 sewn along edges of the side panels 21, 22 and the end panel 23. The elastic flange 32 and elastic end strap 25 cooperate to position and retain the decorative covering 20 on the box spring 11, such that the side panels 21, 22 wrap entirely around the opposing sides 18, 19 of the box spring 11 and portions of the head and foot ends 16, 17, and extend across portions of the top and bottom surfaces 14, 15. The end panel 23 entirely wraps the foot end 17 of the box spring 11, and also extends across portions of the top and bottom surfaces 14, 15. As best shown in FIGS. 2 and 3, the stretched side panels 21, 22 have generally U-shaped cross-sections, and substantially encase side margins of the box spring 11 from its vertical sides 18, 19 to points about 8-12 inches inwardly. Likewise, the stretched end panel 23 has a similar U-shaped cross-section, and substantially encases an end margin of the box spring 11 from its vertical foot end 17 to a point about 8-12 inches inwardly. In one embodiment, the side and end panels 21-23 cover less than 80% of the entire top surface 14 of the box spring 11, and less than 80% of the entire bottom surface 15 of the box spring 11. In another embodiment, the side and end panels 21-23 cover less than 40% of the entire top surface 14 of the box spring 11, and less than 40% of the entire bottom surface 15 of the box spring 11. In yet another embodiment, the side and end panels 21-23 cover less than 20% of the entire top surface 14 of the box spring 11, and less than 20% of the entire bottom surface 15 of the box spring 11.

Tailored foot-end and head-end corner pockets 41, 42, 43, and 44 are integrally formed with the side panels 21, 22 of fabric covering 20, and are designed with sufficient depth to receive respective corners of the box spring 11. Each tailored pocket 41-44 may have a depth of between about 5 and 15 inches, depending on the particular depth of the box spring 11.

The exemplar bed skirt 10 may be constructed of any suitable knit, woven, or nonwoven fabric or other decorative material, and may be both stain resistant and flame retardant. One exemplary fabric comprises a polyester blend featuring roughly 92% polyester, roughly 7% nylon, and less than 1% elastic or stretch yarns (e.g., spandex). The elastic end strap may comprise a blend of polyester and elastic yarns.

Installation of Exemplary Bed Skirt 10

Referring to FIGS. 6-9, the exemplary bed skirt 10 may be installed according to any one or more of the following steps. The bed skirt 10 is first placed in a relaxed (loose) condition on the top mattress "M" with the elastic end strap 25 located nearest the headboard or wall. The fabric end panel 23 of the decorative covering 20 is then pulled and stretched over the mattress "M", and the foot-end pockets 41, 42 applied to the foot-end corners of the box spring 11—either one corner at a time, or simultaneously if two people are installing. The head-end pockets 43, 44 and elastic end strap 25 remain loosely arranged on top of the mattress "M". Both fabric side panels 21, 22 are then stretched towards the headboard or wall—either one at a time or simultaneously—to apply the head-end pockets 43, 44 to respective head-end corners of the box spring 11. The elastic end strap 25 is stretched over the mattress "M" and positioned along the vertical head end 16 the box spring 11. Finally, the fabric side panels 21, 22 are pulled down from the mattress to properly align with and cover the vertical sides 18, 19 of the box spring 11, and are tucked inwardly across marginal portions of the top and bottom surfaces 14, 15. This may require slight lifting of the mattress "M" from the box spring 11, and the box spring 11 from its underlying base or frame "F". The elastic flanged edge 32 of the decorative covering 20 help position and retain the bed skirt 10 on the box spring 11 in a closely fitting (snug) condition.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A bed structure, comprising:

flat top and bottom surfaces, opposing vertical head and foot ends, and opposing vertical sides; and a bed skirt applied to said bed structure, and comprising:

(i) a decorative fabric covering comprising first and second side panels and an end panel formed with said side panels, said side and end panels cooperating to cover the vertical sides and vertical foot end of the bed structure, and defining a generally U-shaped form when applied to the bed structure; and wherein said decorative fabric covering further comprises opposing integrally formed head-end corner pockets adapted to receive respective corners of the bed structure at the head end, and opposing integrally formed foot-end corner pockets adapted to receive respective corners of the bed structure at the foot end, and wherein each head-end corner pocket is configured to engage portions of the top and bottom surfaces, vertical head end, and vertical side of the bed structure and thereby wrap around and cover opposite portions of the head end of the bed structure; and (ii) an elastic end strap attached to said opposing head-end corner pockets of said decorative fabric covering thereby joining said first and second side panels together, such that said elastic end strap extends between said opposing head-end corner pockets and along less than an entire horizontal dimension of the head end of the bed structure, and wherein said elastic end strap has a width dimension designed to be less than a height of the vertical head end of the bed structure, such that no portion of said end strap extends across the top or bottom surfaces of the bed structure.

2. The bed structure according to claim 1, wherein said decorative fabric covering further comprises a continuous elastic flange sewn along opposing edges of said side panels and said end panel.

3. The bed structure according to claim 1, wherein said decorative fabric covering extends across less than 40% of the top surface of the bed structure.

4. The bed structure according to claim 3, wherein said decorative fabric covering extends across less than 40% of the bottom surface of the bed structure.

5. The bed structure according to claim 1, wherein each foot-end corner pocket has a depth of between 5 and 15 inches.

6. The bed structure according to claim 1, wherein each head-end corner pocket has a depth of between 5 and 15 inches.

7. The bed structure according to claim 1, wherein the side and end panels of said decorative fabric covering comprise elastic yarns.

8. A fitted bed skirt for a rectangular bed structure having flat top and bottom surfaces, opposing vertical head and foot ends, and opposing vertical sides, said bed skirt comprising:

a decorative fabric covering comprising first and second side panels and an end panel formed with said side panels, said side and end panels cooperating to cover the vertical sides and vertical foot end of the bed structure, and defining a generally U-shaped form when applied to the bed structure; and wherein said decorative fabric covering further comprises opposing integrally formed head-end corner pockets adapted to receive respective corners of the bed structure at the head end, and opposing integrally formed foot-end corner pockets adapted to receive respective corners of the bed structure at the foot end, and wherein each head-end corner pocket is configured to engage portions of the top and bottom surfaces, vertical head end, and vertical side of the bed structure and thereby wrap around and cover opposite portions of the head end of the bed structure; and an elastic end strap attached to said opposing head-end corner pockets of said decorative fabric covering thereby joining said first and second side panels together, such that said elastic end strap extends between said opposing head-end corner pockets and along less than an entire horizontal dimension of the head end of the bed structure, and wherein said elastic end strap has a width dimension designed to be less than a height of the vertical head end of the bed structure, such that no portion of said end strap extends across the top or bottom surfaces of the bed structure.

9. The fitted bed skirt according to claim 8, wherein said decorative fabric covering further comprises a continuous elastic flange sewn along opposing edges of said side panels and said end panel.

10. The fitted bed skirt according to claim 8, wherein said decorative fabric covering extends across less than 40% of the top surface of the bed structure.

11. The fitted bed skirt according to claim 8, wherein said decorative fabric covering extends across less than 40% of the bottom surface of the bed structure.

12. The fitted bed skirt according to claim 8, wherein each foot-end corner pocket has a depth of between 5 and 15 inches.

13. The fitted bed skirt according to claim 8, wherein each head-end corner pocket has a depth of between 5 and 15 inches.

14. The fitted bed skirt according to claim 8, wherein the side and end panels of said decorative fabric covering comprise elastic yarns.

15. A fitted bed skirt for a rectangular bed structure having flat top and bottom surfaces, opposing vertical head and foot ends, and opposing vertical sides, said bed skirt comprising:

a decorative fabric covering comprising first and second side panels and an end panel formed with said side panels, said side and end panels cooperating to cover the vertical sides and vertical foot end of the bed structure, and defining a generally U-shaped form when applied to the bed structure; and wherein said decorative fabric covering further comprises opposing integrally formed head-end corner pockets adapted to receive respective corners of the bed structure at the head end, and opposing integrally formed foot-end corner pockets adapted to receive respective corners of the bed structure at the foot end, and wherein each of said head-end corner pockets and said foot-end corner pockets has a depth of between 5 and 15 inches, and wherein each head-end corner pocket is configured to engage portions of the top and bottom surfaces, vertical head end, and vertical side of the bed structure and thereby wrap around and cover opposite portions of the head end of the bed structure; and an elastic end strap attached to said opposing head-end corner pockets of said decorative fabric covering thereby joining said first and second side panels together, such that said elastic end strap extends between said opposing head-end corner pockets and along less than an entire horizontal dimension of the head end of the bed structure, and wherein said elastic end strap has a width dimension designed to be less than a height of the vertical head end of the bed structure, such that no portion of said end strap extends across the top or bottom surfaces of the bed structure.

16. The fitted bed skirt according to claim 15, wherein said decorative fabric covering further comprises a continuous elastic flange sewn along opposing edges of said side panels and said end panel.

17. The fitted bed skirt according to claim 15, wherein said decorative fabric covering extends across less than 40% of the top surface of the bed structure.

18. The fitted bed skirt according to claim 15, wherein said decorative fabric covering extends across less than 40% of the bottom surface of the bed structure.

* * * * *